US005818386A

United States Patent [19]

Belisle

[11] Patent Number: 5,818,386

[45] Date of Patent: Oct. 6, 1998

[54] DESIGN OF AN ELECTRONIC BEAM FORMING NETWORK FOR PHASED ARRAY APPLICATIONS

[75] Inventor: Claude Belisle, Chelsea, Canada

[73] Assignee: Her Majesty the Queen in right of Canada as represented by Communications Research Centre, Ottawa, Canada

[21] Appl. No.: 755,209

[22] Filed: Nov. 22, 1996

[51] Int. Cl.[6] ..... H01Q 3/22

[52] U.S. Cl. ..... 342/372; 342/81; 342/157; 342/375

[58] Field of Search ..... 342/81, 157, 372, 342/375

[56] References Cited

U.S. PATENT DOCUMENTS

| | | | |
|---|---|---|---|
| 3,766,555 | 10/1973 | Butcher et al. | 343/100 SA |
| 3,858,208 | 12/1974 | Parke et al. | 343/7.5 |
| 4,313,116 | 1/1982 | Powell et al. | 343/100 LE |
| 4,450,447 | 5/1984 | Zebker et al. | 343/17.7 |
| 4,757,318 | 7/1988 | Pulsifer et al. | 342/375 |
| 5,541,607 | 7/1996 | Reinhardt | 342/372 |

OTHER PUBLICATIONS

Antennas and Radars; Robert J. Mailloux Microwave Journal, Mar. 1988–pp. 28–33.

Array Radars: An Update Part II; Eli Brooker Microwave Journal, Mar. 1987–pp. 167–174.

Planar Millimeter–Wave Arrays; Farzin Lalezari, Theresa C. Boone, J. Mark Rogers Microwave Journal, Apr. 1981–pp. 85–92.

Optical Beamforming Techniques for PhasedArray Antennas; Alwyn Seeds Mircowave Jiurnal, Jul. 1992–p. 74–83.

Novel optical technique for phased–array processing; John H. Hong, Ian McMichael Optical Engineering, Dec. 1991, vol. 30 No. 12.

Phased Array Antenna Beamforming Using Optical Processor; L.P. Anderson, F. Boldissar, D.C.D. Chang The American Institute of Aeronautics and Astronautics, Inc.–pp. 1279–1288.

Signal Distribution Techniques for Active Phased–Array Antennas, H. Wong, S.,S. Chang and T.Q. Ho Microwave Journal Jun. 1991–pp. 147–151..

Beam Steering of Planar Phased Arrays–Feeding and Phasing systems, T.C. Cheston pp. 219–221.

Introduction to Radar Systems, M. Skolnik McGraw–Hill 1962–pp. 310–320.

Transmitreceive time–delay beam–ormding optical architecture for phased–array antennas, N.A. Riza Applied Optics pp.–4594–4595.

The First Demonstration of an Optically Steered Microwave Phased Array Antenna Using True–Time Delay, Wille Ng, Andrew A. Walston, Gregory L. Tangonan, Jar Juch Lee, Irwin L. Newberg, Norman Bernstein IEEE 1991.

Fiber Optic Signal Distribution for Phased Assay Antennas, G. Stephen Mecherle The American Instiuite of Aeronautics and Astronautics, Inc. pp. 1272–1278.

*Primary Examiner*—Thomas H. Tarcza
*Assistant Examiner*—Dao L. Phan
*Attorney, Agent, or Firm*—Neil Teitelbaum & Associates

[57] ABSTRACT

A phased array antenna element design and method of using same is disclosed wherein the antenna elements are each provided several signals containing phase, and amplitude information for controlling a beam transmitted or received. The signals are mixed within each antenna element to produce RF signals for transmission or for use as filtering signals for reception. The signals are selected such that some antenna elements receive a same signal and more particularly, such that a single signal is provided to each row of the array and to each column of the array. The row and column signals are combined at elements located at an intersection of the row and column.

20 Claims, 5 Drawing Sheets

DESIGN OF AN ELECTRONIC BEAM FORMING NETWORK FOR PHASED ARRAY APPLICATIONS

FIELD OF THE INVENTION

This invention relates generally to controlling a beam transmitted from a phased array antenna and more particularly to reducing the complexity of the circuitry for controlling such a beam.

BACKGROUND OF THE INVENTION

Phased array antennas are in development for many radar and communication applications. Some current work in the field of phased array antenna design is outlined in R. J. Mailloux, "Antennas and Radar", Microwave Journal, March 1987, pp. 28–33, E. Brookner, "Array Radars: An Update", Microwave Journal, March 1987, pp. 167–174, and F. Lalezari, T. C. Boone, J. M. Rogers, "Planar millimeter-wave arrays", Microwave Journal, April 1991, pp. 85–92 which are hereby incorporated by reference. Phased array antennas offer several advantages over conventional antennas. For example, beam steering is possible without any mechanical movement of an antenna, side-lobe cancellation is achievable electronically, two-dimensional scanning becomes more flexible, power consumption can be reduced, and phased array antennas have a much higher protection against catastrophic failure. However, the large number of transmit/receive modules—in the order of 10,000 in some cases—forming these phased array antennas presents some demanding requirements. The signal distribution to and from each antenna element creates formidable topology, EMI, and crosstalk problems. These problems are discussed by H. Wong, S. S. Chang, and T. Q. Ho in "Signal Distribution techniques for active phased-array antennas", Microwave Journal, June 1991 pp. 147–154 herein incorporated by reference. The phase and amplitude control of the signals for each element, is not a trivial matter as discussed by T. C. Cheston in "Beam steering of planar phased array", Proceedings of the 1970 phased array antenna symposium, pp. 219–221 herein incorporated by reference.

In current phased array antennas, phase and amplitude control of the transmit or receive signals for beam steering and beam nulling is done at the antenna element according to a control signal sent by a central processor. This approach presents a number of drawbacks. First, for an M·N element array, M·N phase and amplitude shifters are required. Second, the two most critical functions of beam forming—phase and amplitude control—are maintained at the antenna element. Knowing that the performances of phase shifters and variable amplifiers vary with temperature, sophisticated feedback circuitry must be included at each antenna element increasing fabrication costs. Third, RF signals and control signals are distributed to each antenna element rendering the distribution network complex.

In an attempt to overcome these limitations, a number of methods have evolved for beam steering. In "Introduction to radar system", McGraw-Hill, 1962, p. 311 and herein incorporated by reference, M. Skolnik proposes a method of RF frequency scanning where, by changing the transmit frequency, the output beam would be steered because of path delay in the distribution network. Skolnik indicated how the method could be extended to two dimensions. The method however, requires large bandwidth and output frequencies are dependent on beam position.

In "Optical beam forming techniques for phased-array antennas", Microwave Journal, July 92, pp. 74–83 and herein incorporated by reference, A. Seeds proposes a modification to the method of Skolnik, by providing an additional signal, which, when mixed with a first signal, removes the frequency shift created for beam steering. The method is proposed for a one-dimensional array and for the transmit mode of a radar application. The method makes use of optical fibres of known lengths for generating path delays.

SUMMARY OF THE INVENTION

In accordance with the invention a method of controlling a beam is provided for a phased array antenna having a plurality of antenna elements disposed in a predetermined pattern for radiating first RF signals having relative phase and amplitude characteristics and formed by a combination of second RF signals provided thereto. The a method comprises the steps of:

(a) digitally computing the phase and amplitude characteristics of the first RF signals required at some phased array antenna elements, using a processor;

(b) digitally computing, for some phased array antenna elements, a plurality of second RF signals wherein a combination of some of the plurality of second RF signals at phased array antenna elements results in substantially an approximation of required first RF signals as computed in step (a) and wherein some of the second RF signals are substantially the same;

(c) generating the plurality of second RF signals as computed in step (b) for some phased array antenna elements;

(d) providing to some phased array antenna elements the generated second RF signals for said phased array antenna elements; and (e) from said phased array antenna elements, radiating a combination of the generated second RF signals provided thereto.

An advantage of the present invention is a reduction of phase shifters required heretofore.

A further advantage of the present invention is a lower fabrication cost for a phased array antenna element, greater stability of phase control and a reduction in required control lines and therefore in fabrication cost for a phased array antenna.

A further advantage of the present invention is improved signal-to-noise ratio and dynamic range.

A further advantage of the present invention is flexibility of using a fibre optic network for signal distribution.

A potential advantage of the present invention relates to the accommodation of simultaneous multiple beams.

A further potential advantage of the present invention relates to the accommodation of frequency hopped bandwidths.

BRIEF DESCRIPTION OF THE DRAWINGS

Exemplary embodiments of the invention will now be described in conjunction with the following drawings, in which.

Figure 1:
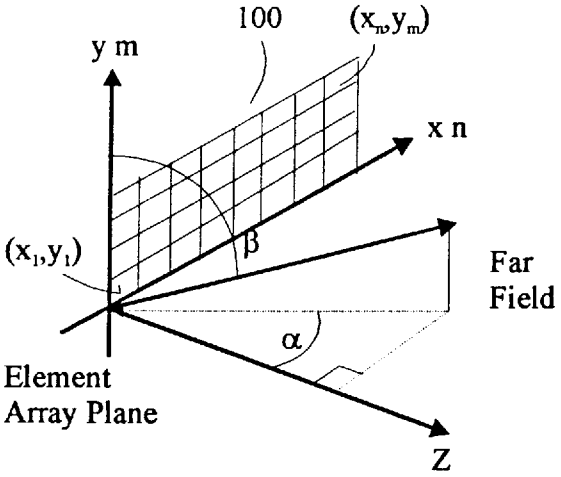
FIG. 1 is three dimensional graphical representation showing numeric symbols used within the application.
Figure 4:
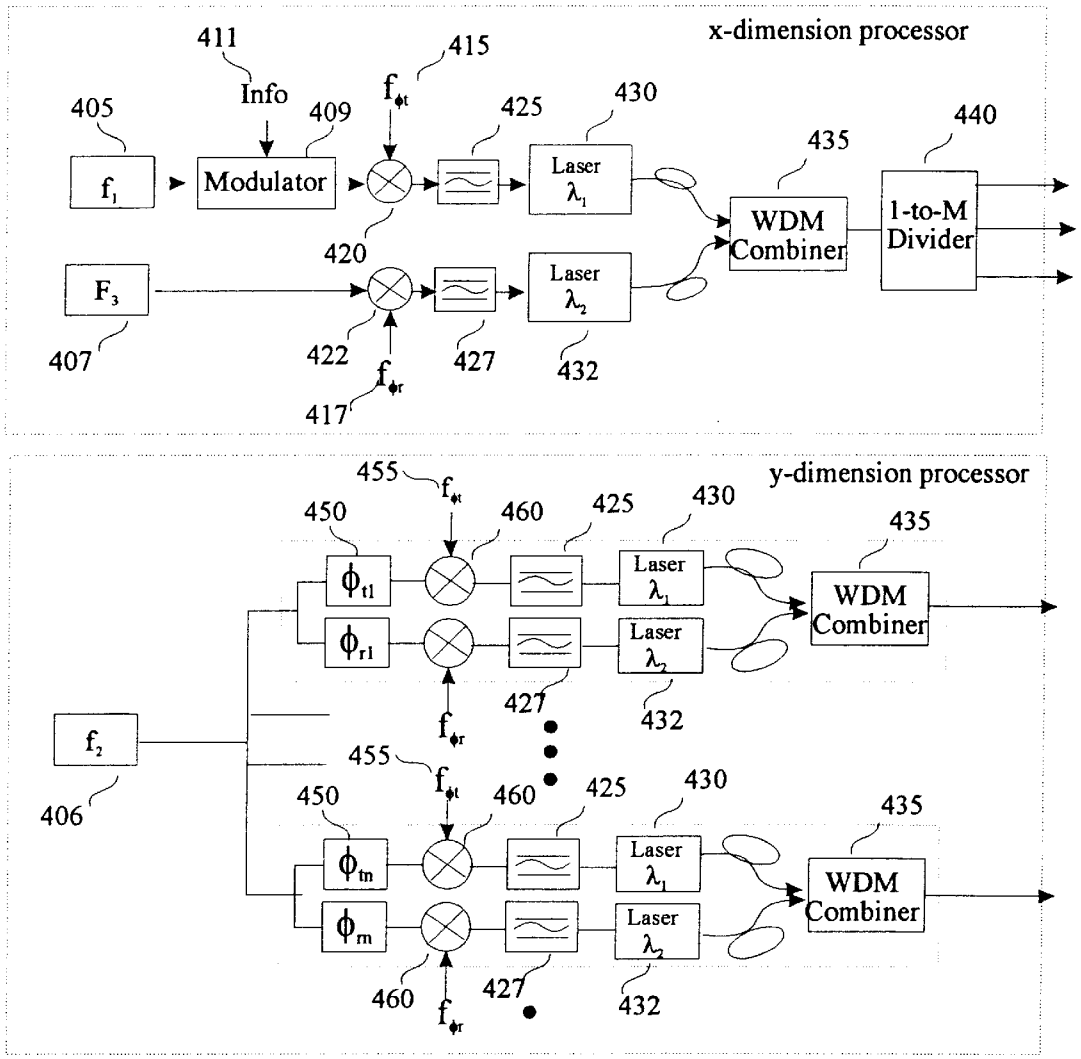
Figure 5:
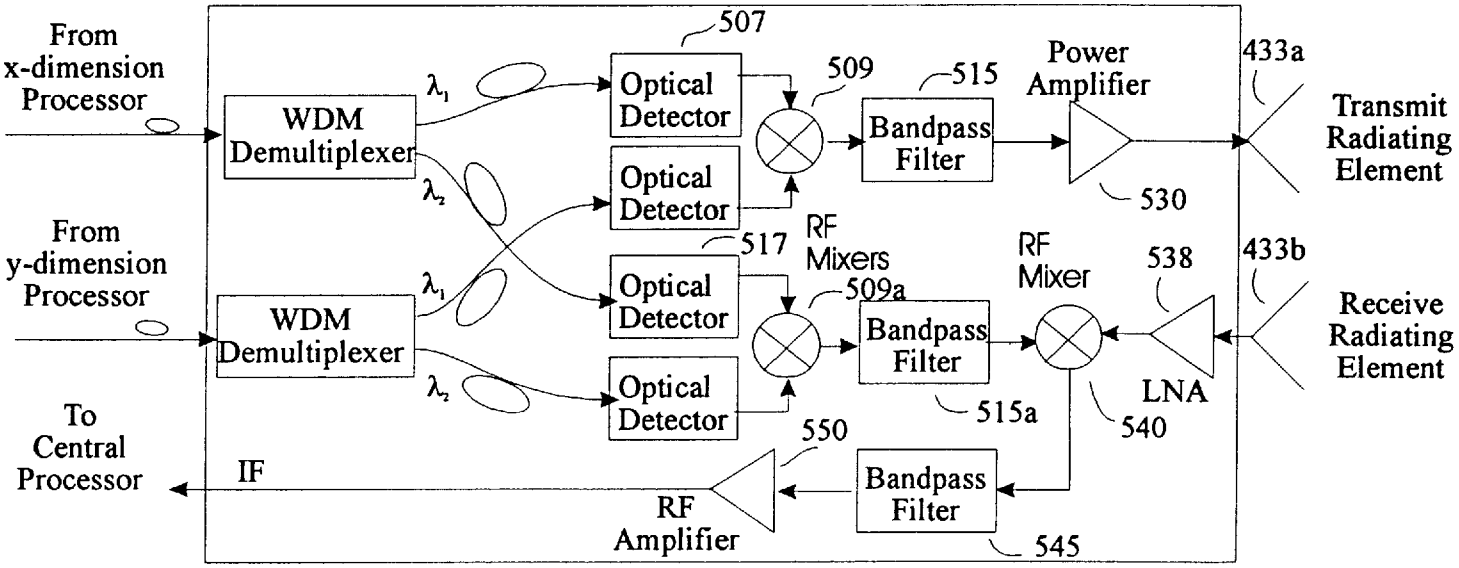

FIG. is a simplified block diagram of an antenna element interface unit, shown out of order a page with FIG. 1;

FIG. 4 is a simplified block diagram of an architecture for a processor for use in communication; and FIG. 5 is a simplified block diagram of an antenna element interface unit for use in communication.

DETAILED DESCRIPTION OF THE INVENTION

The present invention proposes an improved method of controlling beams in a phased array antenna implementation wherein the array has N rows and M columns. An opto-electronic architecture is described that allows for beam steering with fewer than N·M phase shifters. In the embodiment described herein, phase control is performed in a central processor unit where environmental factors are more easily controlled. Using a central processor, the number of phase shifters is reduced to M using two extra frequency synthesisers. Dynamic amplitude control is performed at specific locations.

A beam forming network (BFN), as presented, allows a same architecture to be used at a plurality of frequencies of operation without redesign. This allows for manufacture of a single phased array antenna for a broad range of applications. In an embodiment, signal distribution is performed through a fibre-optic network allowing a more flexible and lighter distribution network with lower propagation loss and immunity to electromagnetic interference.

Referring to FIG. 1 a general geometry is shown. An N·M array of elements 100 at a plane of an antenna is shown. A field at element (n, m), located at $(x_n, y_m)$, has phase $\phi(x_n, y_m)$, and amplitude $A_{n,m}$. A far field pattern of this two-dimensional array antenna in a direction (α, β) has a form $$E(\alpha, \beta) = \sum_{n=1}^{N} \sum_{m=1}^{M} A_{n,m} e^{j(2\pi ft - \frac{2\pi}{\lambda} \sin\beta[x_n \cos\alpha + y_m \sin\alpha] + \phi(x_n, y_m))} \quad (1)$$

where;

α
angle of far field point measured from the z axis in the x-z plane,

β
angle of far field point measured from the y axis, in the y-z plane

λ
RF mid-band free space wavelength,

N
number of columns in the antenna,

M
number of rows in the antenna, f
frequency of operation (=c/λ), c
velocity of EM wave n
element number in x dimension ranging from 1 to N m
element number in y dimension ranging from 1 to M Beam steering to the direction (α, β) is accomplished on either transmit or receive by applying appropriate phase shifts $\phi(x_n, y_m)$ to a received or transmitted signal. Using a brute force method and according to the prior art, all N·M elements are provided with a phase shifter to set phase shifts, $\phi(x_n, y_m)$. Similarly, beam shaping is accomplished by appropriately applying amplitude weights, $A_{n,m}$.

From equation (1), the phase $\phi(x_n, y_m)$ that results in a single beam in the direction of α and β is shown to have a form $$\phi(x_n, y_m) = \phi(x_n) + \phi(y_m)$$

where $$\phi(x_n) = \frac{2\pi}{\lambda} \sin\beta x_n \cos\alpha \quad (2)$$

$$\phi(y_m) = \frac{2\pi}{\lambda} \sin\beta y_m \sin\alpha$$

Thus, phases for a two dimensional array are separable into $x_n$ and $y_m$. Relying on this separability, the present invention employs one phase shifter per row and one per column to steer a beam to a direction (α, β). As there are N rows and M columns, this results in M+N necessary phase shifters instead of M·N according to the prior art. Further simplification is achieved by taking advantage of the fact that the separated phases are linearly proportional to the co-ordinates $x_n$, and $y_m$. The separated signals are described below with reference to a signal in a first direction or dimension, and a signal in a second direction or dimension. It will be apparent to one of skill in the art, that further directions of dimensions are employed when RF signals are separated into more than 2 component signals.

In some radar applications and in a number of communication systems, amplitude control is only performed on a received signal. Moreover, the amplitude control is often fixed in one direction and dynamically varied in another direction. When this is the case, one set of amplifiers is fixed and M variable amplifiers are provided and addressed, i.e. one per column instead of one per element. When amplitude control can not be separated into a first dimension and a second dimension, variable amplifiers or attenuators with corresponding distribution networks are used for every element.

Figure 2:
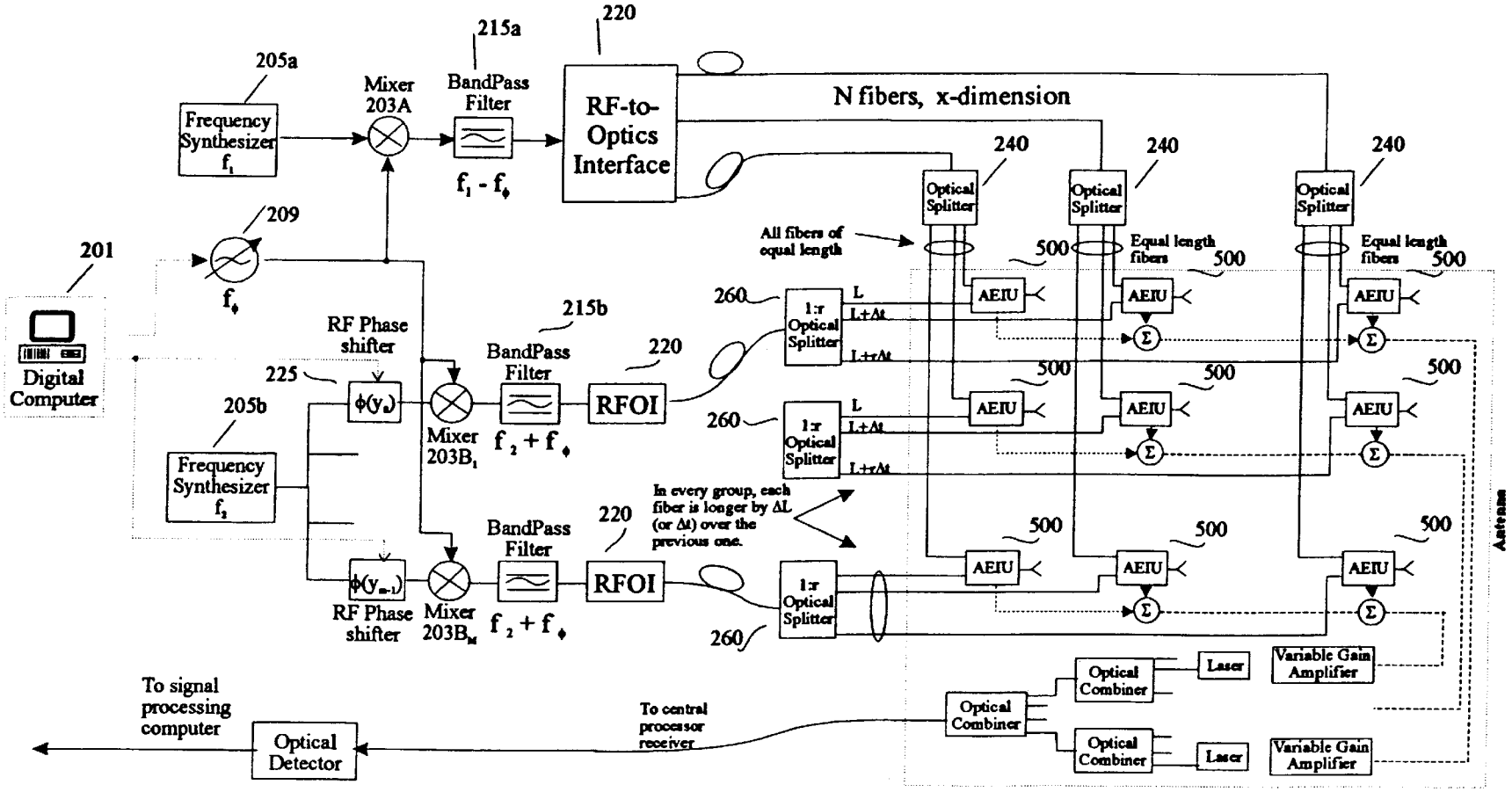
FIG. 2 is a simplified block of an embodiment of the present invention.

Referring to FIG. 2 a block diagram of an optically controlled array of antenna element interface units (AEIU) having a controller section for computing and generating signals for distribution and a distribution network for transmitting to the antenna elements the generated signals is shown. A computer 201 is provided with a desired beam shape and direction. The computer 201 computes required amplitude and phase of RF signals required at each antenna element in order to steer a beam as desired. The computer further calculates specifications for a plurality of RF signals that, when combined, at an antenna element, result in the computed required amplitude and phase of the required RF signal. The computer 201 also computes an application of phase settings on the RF signals required for transmit operation and for receive operation. Alternatively, the computer 201 calculates an RF to RF conversion required to maintain phase during transmission of the signal to the phased array antenna elements.

An object is to generate a signal at antenna element interface unit (n, m) at some frequency $f_0$ in the form of IF or RF, and having a phase $\phi(x_n, y_m)$; a combination of such signals emitted by the antenna array, forms a steered or directed beam. To this end, three signals are combined. Two are fixed frequency signals having frequencies $f_1$ and $f_2$. These two signals are selected such that $$f_1 + f_2 = f_0 \quad (3)$$

the frequency of the desired signal at the antenna element interface units. The third signal has a frequency $f_{100}$, defining x dimension phase settings for the combined signal at an antenna element. The signal with frequency $f_1$ is generated by a frequency synthesizer 205*a*. The signal with frequency $f_2$ is generated by a frequency synthesizer 205*b*. The signal having a frequency $f_{100}$ is Generated by a frequency generator 209 controlled by the computer 201 and is mixed individually with signals having frequencies $f_1$ and $f_2$ in conventional frequency mixers 203A and 203B. At mixer 203*a*, one sideband, for example $f_1-f_\phi$, is maintained by filtering the mixed signal with a bandpass filter 215*a*; at mixer 203B another sideband, in our example $f_2+f_\phi$, is maintained by filtering the mixed signal with a bandpass filter 215*b*. The filtered signals at frequencies $f_1-f_\phi$ and $f_2+f_\phi$, respectively, are converted to the optical domain by RF-to-Optics converters 220 and the optical signals are transmitted to the antenna elements 500 on optical fibres. The conversion to the optical domain may be achieved by various means such as by modulating the intensity of a laser source or using external modulation. The conversion of the signals to optical signals ensures that at antenna elements, phase information is not lost. Alternatively, optical signals are generated by an optical signal generator and no conversion is necessary. Further alternatively, another means of transmitting the signals to the antenna elements is provided which allows for maintenance of phase information within the signals.

The y-dimension phase shifts, $\phi(y_m)$, are applied to frequency, $f_2$, through M conventional RF phase shifters 225, one per column of the antenna. Alternatively, the phase shifters, $\phi(y_1)$ to $\phi(y_M)$ are replaced by optical time delays rendering y-dimension beam steering frequency independent. The x-dimension phase settings $\phi(x_n)$, are based on a value of $f_\phi$, and are performed using a differential delay network. Alternatively, optical heterodyne techniques are used to generate frequencies $f_1$ and $f_2$ allowing for use of optical phase shifters instead of RF phase shifters.

The optical signals are split using optical splitters 240 and then provided to antenna element interface units for a row or column of the antenna. Alternatively, another grouping is applied to antenna elements and overlapping groups are providing with a plurality of signals in a plurality of directions.

Delay-Line Distribution Network Using Fibre Optics

As shown in FIG. 2, the x-dimension frequency, $(f_1-f_{100})$, is distributed to each antenna element in parallel, that is every signal arrives in phase at each element within a column. The y-dimension frequency, $(f_2+f_\phi)$, is distributed sequentially in each row, with a delay of $\Delta t$ between each antenna element. A phase weight of a n element (n, m), may be rewritten as:

$$\phi(x_n, y_m)=\phi(y_m)+2\pi(n-1)\Delta t(f_2+f_\phi) \tag{4}$$

An incremental path delay, $\Delta t$, is related to a path length difference, $\Delta l$ , through $\Delta t=\Delta l * \eta/c$ where $\eta$ is the refractive index of a fibre and c the light velocity. $\Delta l$ is implemented by incremental increases in fibre length as seen in FIG. 2. $\Delta t=k/f_2$–k is an integer—and the frequency $f_\phi$ required to position the beam in the $\alpha$, $\beta$ direction is given by:

$$f_\phi = f_2\left(\frac{d}{\lambda_0 k}\right)\sin\beta\cos\alpha$$

where d is the physical antenna element spacing in the x dimension and $\lambda_0$ is a free space wavelength of $f_1+f_2$, i.e. $\lambda_0=c/(f_1+f_2)$. The fiber length difference, $\Delta l$, between adjacent elements in a row is $k(c/\eta f_2)$.

Location of Information Modulation

In all applications there is some waveform or information modulated onto a transmitted and/or received carrier signal. Once modulation is added, there is no longer a single sine wave as was assumed in the above disclosure and mathematical calculations, therefore, bandwidth is considered.

From equation (3), a desired signal is seen to have a centre frequency at the input to the antenna element interface units of $f_1+f_2=f_0$. A phase, $\phi(x_n, y_m)$, is required to point a signal at the centre frequency in a direction ($\alpha$, $\beta$). The modulation needed for a transmit operation is applied to the signal having a frequency $f_1$. Alternatively, the modulation is applied to the signal having a frequency $f_2$. Modulation is described with reference to the signal having a frequency $f_1$ because conceptually, this results in an information signal in one direction and a beam steering signal in another direction. Alternatively, both information and steering information are carried by a single signal. Further alternatively, some steering information and some signal information are carried by a signal in each direction.

An output signal, $A_1 \cos(2\pi f_1 t)$, from a frequency synthesizer for $f_1$ 205*a* is modulated prior to mixing the signal in mixer 203A. The modulation is a mix of amplitude, a(t), and phase, $\theta(t)$, modulation so that a general modulated waveform is defined as $$s_1(t)=a(t)\cos(2\pi f_1 t+\Theta(t)) \tag{6}$$

For radar, a(t) is a pulse envelope and $\Theta(t)$ is a linear FM for pulse compression. Alternatively for radar, a(t) and $\Theta(t)$ have other forms. For communications, the modulation is one of the many forms of analog or digital modulation. Alternatively, for communications, a(t) and $\Theta(t)$ have other forms.

The modulated signal, $s_1(t)$ has a non-zero bandwidth, $B_1$, centred about frequency $f_1$. All circuits receiving a modulated signal are capable of handling this bandwidth. Furthermore, steering frequency, $f_\phi$, calculated using equation (5) steers in the desired direction for signals at $f_0$. Therefore, some beam steering error will occur for $s_1(t)$ with a non-zero bandwidth; this results from the presence of other frequency signals within the steered signal. Therefore, it is preferable to choose $$f_0 >> B_1. \tag{7}$$

Certain systems that have wide total bandwidths, have relatively narrow instantaneous bandwidths. The steering frequency, $f_\phi$, is calculated in dependence upon the instantaneous bandwidth and recalculated or modified whenever the center of the bandwidth changes. An example for use in radar is frequency agile radar devices, and for use in communications an example is frequency hopping spread spectrum devices.

For receive operation of an antenna, a system as described herein is unchanged, $f_1$, $f_2$, and $f_\phi$ are single frequencies as described above, and signals having those frequencies are provided to the antenna element interface units. The signals are provided in a fashion that maintain s phase information of the signals. At the antenna element interface units, the reference wave forms are mixed with the received signal to generate a received signal at an IF. The IF is transmitted from the antenna element interface units by the addition of an extra communications path. The IF signal is transmitted electrically. Alternatively, the IF signal is converted to an optical signal and transmitted via a fibre. In FIG. 2, an optical communication path for the IF signal is shown. The individual signals are combined into a single final receive signal from a plurality of antenna elements. The mixing of the three generated signals and the received signal at the antenna element interface unit, produces a received signal that is substantially directed as required for phased array antenna operation.

Antenna Element Interface Unit

Generally, a device is needed at each antenna element that interfaces between a main controller and individual elements. Operations of the interface unit include phase shifting, up and down conversions, and optical-to-RF conversions. Alternatively, another form of phase distribution is used in place of optical distribution. One antenna element interface unit is required per antenna element; alternatively, one antenna element interface unit is required for a plurality of antenna elements.

In many radar systems and many communications systems, it is preferable to use a same element array for both transmit functions and receive functions. Using pulsed radar, the transmit and receive signals propagate at a same frequency but are separated in time allowing multiplexing of the transmit and receive signals using a T/R module. In communications systems requiring simultaneous transmit and receive at a same element array, RF frequencies differ. A module corresponding to a radar T/R module performs "diplexing." Systems providing transmit and receive from the same array antenna have more complex antenna element interface units than those of similar transmit or receive antennas.

Figure 3:
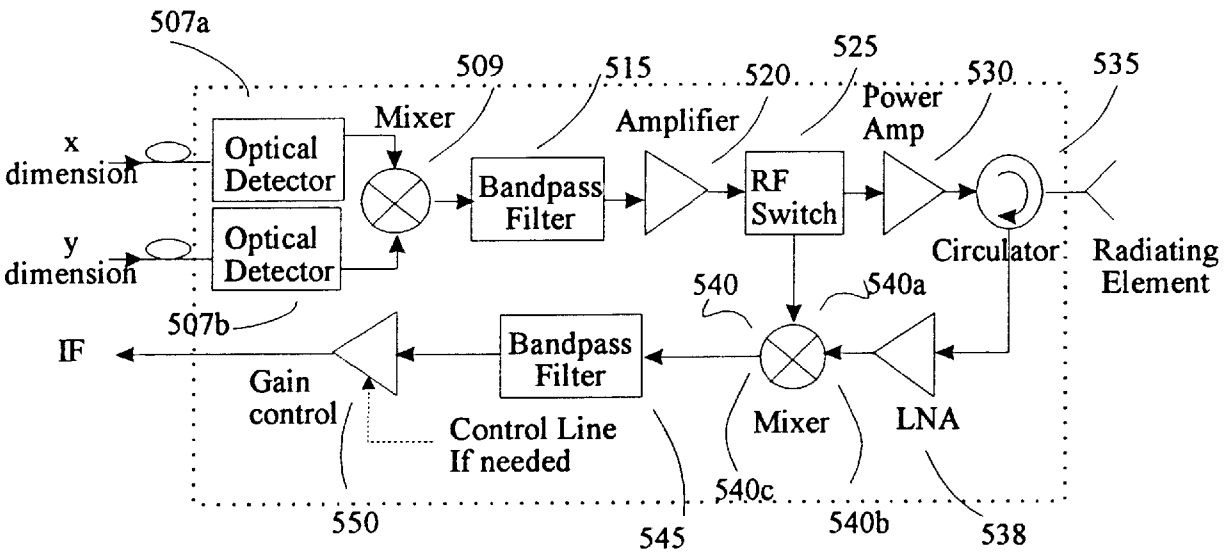

Referring to FIG. 3, a schematic diagram of the antenna element interface units for a pulsed radar application is shown. Antenna element interface units connect a distribution system to antenna radiating elements 533. Design of antenna element interface units is application specific. Some sample applications for use in a method and device according to the present invention are described below along with a description of appropriate antenna element interface units.

A same beam steering network is used for both the transmit and receive signals. Alternatively, separate beam steering networks are used. Each antenna element receives, from a processor unit not shown, two optical signals corresponding to x- and y-dimension information. It will be apparent to those of skill in the art that a number of signals greater than two may be provided when appropriate. The two optical signals are converted to first electrical signals by optical detectors 507*a* and 507*b*. The desired RF signal at the antenna element and having proper phase, is obtained by mixing the two first electrical signals with a mixer 509 and filtering the desired sideband ($f_1+f_2$) using a bandpass filter 515 to provide a second electrical signal. The second electrical signal is amplified by an amplifier 520 and provided to an RF switch 525. During transmission, the RF switch 525 directs the amplified second electrical signal towards a power amplifier 530 from which it is provided to a radiating element 533. A circulator 535, disposed between the power amplifier 530 and the radiating element 533 allows transmit receive functions on a single beam steering network. During reception, the RF switch 525 directs the amplified second electrical signal towards a local oscillator (LO) port 540*a* of a front end mixer 540. A received signal is provided to the circulator 535 and passes therethrough to an amplifier 538 and the amplified signal is provided to an RF port 540*b* of the mixer 540. Consequently, the intermediate frequency port 540*c*, provides a third electrical signal at a difference frequency and having a phase equal to the difference between the phase of the local oscillator and the RF signals provided to the mixer. The third electrical signal is filtered by a filter 545 and amplitude control is accomplished by a gain control circuit 550. The gain control is maintained in one of the two dimensions. Alternatively, gain control is maintained in a plurality of dimensions.

In some communications applications, a phased array antenna is expected to transmit and receive RF signals, simultaneously. Often, these signals are at different frequencies; phase and amplitude weights required for beam steering are also different. In order to address this problem two steering processors are implemented; however, only one set of fiber differential-delay lines is used. Alternatively two sets of fibre delay lines are used. It will be known to those of skill in the art that a single processor processing two different steered beams can be used. Receive and transmit optical signals are separated from each other by wavelength division multiplexing (WDM). Using WDM, the receive optical signal is carried over an optical wavelength $\lambda_r$ and the transmit optical signal is carried over an optical wavelength $\lambda_t$, as shown in FIG. 4. At the antenna element interface units, the two wavelength are de-multiplexed with a circuit shown in FIG. 5.

It is often desirable to simultaneously transmit and/or receive a plurality of beams. When the prior art approach of one phase shifter per beam for each of the M·N elements is used, beam multiplicity is implemented at an expense of many additional phase shifters. Using the present invention, multiple beams are handled by duplicating the sections that generate signals at frequencies $f_1$, $f_2$, and $f_\phi$. Alternatively, only two signal generators are duplicated. Alternatively, additional sections are incorporated into the antenna circuitry to provide a plurality of signals to each antenna element wherein the plurality of signals is sufficient to control a plurality of beams at each element. The resulting signals are combined in known fashions to provide to each radiating element 533 a desired RF signal independence upon the plurality of beams. When WDM is used for communications with the antenna elements, one set of fibers, for both x and y dimensions, are needed.

For satellite communications and some other applications, it is desirable to operate a terminal in one of a plurality of different bands, and to switch to any of the plurality of bands as desired. Using the present invention, a same beam steering network (BFN) is used and the processor performs calculations in dependence upon an altered frequency band. As such, the design and implementation of adaptable beam forming networks is possible using the present invention.

Referring to FIG. 4, a processor unit for implementation of a simultaneous transmit receive antenna array is shown. Signals having frequencies F1 405, F2 406, and F3 407 are provided as inputs to the processor. The signal 405 is modulated in a modulator 409 and in dependence upon information 411 provided by a computer. Alternatively, the information has a different source. The signal 405 is for transmission from the antenna and the modulated signal is mixed with beam steering information 415 in a mixer 420. The signal 407 is for filtering a signal received by the antenna and the signal 407 is mixed with beam steering information 417 in a mixer 422. The mixed signals are provided to optical conversion circuits 425 and 427 that drive lasers 430 and 432, respectively. The transmit and receive optical signals are combined in a WDM 435 and then provided to antenna elements in a fashion similar to those outline above. In FIG. 4, a divider 440 is used to divide the optical signal and provide portions thereof to each antenna element interface unit.

A second portion of the block diagram of FIG. 4, relates to a second other signal for both transmit and receive operation of the phase array antenna. The signal 406 is delayed by a plurality of phase shifters 450, and mixed with steering information 455 or 456 for transmit and receive, respectively, in mixers 460. The mixed signals are provided to optical conversion circuits 425 and 427 that drive lasers 430 and 432, respectively. The transmit and receive optical signals are combined in a WDM 435 and then provided to antenna elements in a fashion similar to those outline above. In this fashion, a phase array antenna operates as a simultaneous transmit/receive antenna and has a single distribution network therein.

Referring to FIG. 5, an antenna element interface units for simultaneous transmit and receive for a communications application is shown. When only one of the two functions is desired, configuration is simplified accordingly. Separate antenna elements 433*a* and 433*b* are disposed as transmitters and as receivers. The transmit antenna and the receive antenna are treated separately and, therefore, each corresponds with a section described earlier for the general system.

The antenna element interface unit shown in FIG. 5 comprises the same blocks as that of FIG. 3. Additionally, as the transmit and receive operations are performed simultaneously, no circulator is used and instead, some blocks are repeated. Optical detector 517 detects signals for filtering the received signal. The RF signal provided by the optical detector 517 is mixed in a mixer 509*a* and provided to a bandpass filter 515*a*. An RF mixer 540 receives the filtered signal and mixes the signal with the signal received by the antenna receiving radiating element 533*b*. These elements function according to the description of FIG. 3 in its receive mode of operation.

When the RF signal amplitudes and phase of the transmit antenna and of the receive antenna are sufficiently close, it may be possible to use a same array of elements for both transmit and receive operations. Means are needed to separate transmit signals from receive signals. When multiple beams are required, one controller per beam is needed.

When converting an RF signal to an optical signal, amplitude modulation is used. Alternatively, another form of RF to optical conversion is used.

The phased array is typically disposed in rows and columns. For operation of the invention, the phased array is disposed in a predetermined or known pattern in the form of an array of rows and columns, an array of concentric circles, a spiral, or another pattern. When other than an array of rows and columns are used, further phase shifters may be required to maintain beam control. In a further embodiment, a plurality of phased array antennas are disposed in an array wherein each antenna is an antenna element according to the invention. Alternatively, each antenna is an antenna according to the invention. Further alternatively, a plurality of antennas form an antenna according to the invention and the array of antennas comprises a plurality of antennas according to the invention.

Numerous other embodiments may be envisaged without departing from the spirit and scope of the invention.

What is claimed is:

1. In a phased array antenna having a plurality of antenna elements disposed in a predetermined pattern for radiating first RF signals having relative phase and amplitude characteristics and formed by a combination of second signals provided thereto, a method of controlling a beam comprising the steps of:

(a) digitally computing the phase and amplitude characteristics of the first RF signals required at some phased array antenna elements, using a processor;

(b) digitally computing, for each of some phased array antenna elements, characteristics of a plurality of second signals and associating said second signals with said phased array antenna element of said some phased array antenna elements wherein a combination of some of the plurality of second signals at an associated phased array antenna element results in substantially an approximation of the required first RF signal of step (a) and wherein some of the second signals associated with a phased array antenna element are substantially the same as second signals associated with other phased array antenna elements;

(c) generating the plurality of associated second signals with characteristics computed in step (b) for some phased array antenna elements;

(d) providing to some phased array antenna elements the generated second signals for said phased array antenna elements; and (e) from said phased array antenna elements, radiating an RF signal in dependence upon a combination of the generated second signals provided thereto.

2. A method of controlling a beam as defined in claim 1 wherein each of a plurality of second signals is an RF signal provided to phased array antenna elements having a predetermined spatial relation.

3. A method of controlling a beam as defined in claim 1 wherein the step of generating the plurality of second signals includes the steps of generating second RF signals and converting the second RF signals into optical signals, the method further comprising the step of:

converting the optical signals received at an antenna element into RF signals for combination.

4. A method of controlling a beam as defined in claim 1 wherein the digitally computed characteristics of the second signals $$\phi(x_n) = \frac{2\pi}{\lambda} \sin\beta x_n \cos\alpha$$

are of the form $$\phi(y_m) = \frac{2\pi}{\lambda} \sin\beta y_m \sin\alpha$$

5. A method of controlling a beam as defined in claim 1 wherein two second signals are provided to an antenna element and wherein second signals including one of the two second signals and another different second signal are provided to another antenna element.

6. A method of controlling a beam as defined in claim 1 wherein the second signals comprise a fixed frequency signal combined with signals comprising at least one of control information and information for transmission.

7. A method of controlling a beam as defined in claim 1 wherein the second signals comprise a fixed frequency signal combined with signals comprising at least one of phase information and information for transmission.

8. A method of controlling a beam as defined in claim 1 wherein providing to some phased array antenna elements the generated second signals for said phased array antenna elements is performed maintaining relative phase information within the generated second signals.

9. In a phased array antenna having a plurality of antenna elements disposed in a predetermined pattern for receiving first RF signals having relative phase and amplitude characteristics, a method of controlling a beam comprising the steps of:

(a) digitally computing the phase and amplitude characteristics of the first RF signals for reception by some phased array antenna elements, using a processor;

(b) digitally computing, for each of some phased array antenna elements, characteristics of a plurality of second signals and associating said second signals with said phased array antenna element of said some phased array antenna elements wherein a combination of some of the plurality of second signals at an associated phased array antenna element results in substantially an approximation of the required first RF signal for reception as computed in step (a) and wherein some of the second signals associated with a phased array antenna element are substantially the same as second signals associated with other phased array antenna elements;

(c) generating the plurality of associated second signals with characteristics computed in step (b) for some phased array antenna elements;

(d) providing to some phased array antenna elements the generated second signals for said phased array antenna elements; and (e) filtering signals received by said phased array antenna elements in dependence upon a combination of the generated second signals provided thereto.

10. A method of controlling a beam as defined in claim 9 wherein the filtering is performed by combining the second signals with the signal received by an antenna element to generate a receive signal.

11. A phased array antenna comprising:

a plurality of antenna elements disposed in a predetermined pattern for radiating first RF signals having relative phase and amplitude characteristics and formed by a combination of second signals provided thereto;

means for digitally computing the phase and amplitude characteristics of the first RF signals required at some phased array antenna elements;

means for digitally computing, for each of some phased array antenna elements, characteristics of a plurality of second signals and associating said second signals with said phased array antenna element of said some phased array antenna elements wherein a combination of some of the plurality of second signals at an associated phased array antenna element results in substantially an approximation of the required first RF signal as computed in step (a) and wherein some of the second signals associated with a phased array antenna element are substantially the same as second signals associated with other phased array antenna elements;

means for generating the plurality of associated second signals;

means for providing to some phased array antenna elements the generated second signals associated with said phased array antenna elements;

means for combining the generated second signals; and means for radiating, from said phased array antenna elements, an RF signal in dependence upon a combination of the generated second signals provided thereto.

12. A phased array antenna as defined in claim 11, wherein the means for providing to some phased array antenna elements the generated second signals comprises optical transmission means.

13. A phased array antenna as defined in claim 11, wherein the means for providing to some phased array antenna elements the generated second signals comprises RF to optical conversion means; optical transmission means; and optical to RF conversion means.

14. A phased array antenna as defined in claim 11, wherein the means for providing to some phased array antenna elements the generated second signals is for maintaining phase information of the generated second signals.

15. A phased array antenna as defined in claim 11, wherein the plurality of antenna elements disposed in a predetermined pattern for radiating first RF signals are disposed in an array of rows and columns and wherein some means for generating second signals are coupled with a plurality of phased antenna elements in a row and some means for generating second signals are coupled with a plurality of phased array antenna elements in a column.

16. A phased array antenna as defined in claim 11, wherein the means for radiating an RF signal comprises a plurality of means associated with each of a plurality of phased array antenna elements and absent phase shifters, each means for combining the second signals provided thereto.

17. A phased array antenna as defined in claim 11, wherein the means for generating the plurality of second signals comprises a plurality of frequency synthesisers, mixers, filters, and RF to Optical signal conversion circuits.

18. A phased array antenna as defined in claim 17, wherein the means for generating the plurality of second signals further comprises a processor controlled frequency generator.

19. A phased array antenna as defined in claim 11, wherein the plurality of antenna elements disposed in a predetermined pattern are disposed in rows and columns and wherein the means for providing to some phased array antenna elements the generated second signals associated with said phased array antenna elements comprises means coupled to a plurality of antenna elements in one of a row and a column for providing a same second signal to the plurality of antenna elements.

20. A phased array antenna as defined in claim 11, wherein the means for combining the generated second signals comprises: a switch for switchably providing the combined signal to the means for radiating in a first mode of operation and to a filtering circuit for filtering a signal received by the radiating element in a second mode of operation.

* * * * *

UNITED STATES PATENT AND TRADEMARK OFFICE

CERTIFICATE OF CORRECTION

PATENT NO. : 5,818,386

DATED : October 6, 1998

INVENTOR(S) : Belisle

It is certified that error appears in the above-identified patent and that said Letters Patent is hereby corrected as shown below:

On the title page: Item [56] Col. 2, lines 8, 9, and 23

Please replace:

In OTHER PUBLICATIONS
"PhasedArray Antennas" with --Phased-Array Antennas--;
"Jiurnal" with --Journal--;
"Transmitreceive" with --Transmit/receive--;
"ormding" with --forming--;
"Phased Assay Antennas" with --Phased Array Antennas--;
"Instiuite" with --Institute--;

UNITED STATES PATENT AND TRADEMARK OFFICE

CERTIFICATE OF CORRECTION

PATENT NO. : 5,818,386

DATED : October 6, 1998

INVENTOR(S) : Belisle

It is certified that error appears in the above-identified patent and that said Letters Patent is hereby corrected as shown below:

column 2, line 62, "Fig. is" with --Fig. 3 is--;
column 4, line 61, "$f_{100}$" with --$f_{\Phi}$--;
column 4, line 66, "$f_{100}$" with --$f_{\Phi}$--;
column 4, line 66, "is Generated" with --is generated--;
column 5, line 40, "($f_1$-$f_{100}$)" with --( $f_1$-$f_{\Phi}$)--;
column 5, line 45, "of a n element" with --of an element--;
column 6, line 55, "maintain s phase" with --maintains phase--;
column 6, line 60, "communications path" with --communication path--;
column 8, line 18, "two wavelength" with --two wavelengths--;

column 10, lines 35-45 "$\phi(x_n) = \frac{2\pi}{\lambda} \sin\beta x_n \cos\alpha$ are of the form $\phi(y_m) = \frac{2\pi}{\lambda} \sin\beta y_m \sin\alpha$" with --are of the form $\phi(x_n) = \frac{2\pi}{\lambda} \sin\beta\ x_n \cos\alpha$ $\phi(y_m) = \frac{2\pi}{\lambda} \sin\beta\ y_m \sin\alpha$--;

Signed and Sealed this

Thirtieth Day of March, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,818,386
APPLICATION NO. : 08/755209
DATED : October 6, 1998
INVENTOR(S) : Belisle It is certified that error appears in the above-identified patent and that said Letters Patent is hereby corrected as shown below:

Title page, item [30] priority should read as follow:
-- Canadian Patent Appln No: 2,163,692 of November 24, 1995 --

Signed and Sealed this

Twenty-first Day of July, 2009

John Doll

JOHN DOLL
*Acting Director of the United States Patent and Trademark Office*